US005116804A

United States Patent [19]

Kakuda et al.

[11] Patent Number: 5,116,804

[45] Date of Patent: May 26, 1992

[54] THERMOSENSITIVE RECORDING MATERIAL

[75] Inventors: Tomohisa Kakuda, Numazu; Norio Kurisu, Susono, both of Japan

[73] Assignee: Ricoh Company, Ltd., Tokyo, Japan

[21] Appl. No.: 530,337

[22] Filed: May 30, 1990

[30] Foreign Application Priority Data

Jun. 9, 1989 [JP] Japan ..... 1-147728

[51] Int. Cl.[5] ..... B41M 5/30

[52] U.S. Cl. ..... 503/209; 427/150; 503/208; 503/216

[58] Field of Search ..... 427/150-152; 503/208, 209, 216, 225

[56] References Cited

U.S. PATENT DOCUMENTS 4,925,827 5/1990 Goto et al. ..... 503/207

FOREIGN PATENT DOCUMENTS 0306916 3/1989 European Pat. Off. ..... 503/209
59-101392 6/1984 Japan ..... 503/208
59-106456 6/1984 Japan ..... 503/208
59-116262 7/1984 Japan ..... 503/208
61-123584 6/1986 Japan ..... 503/208
61-215087 9/1986 Japan ..... 503/208
61-242889 10/1986 Japan ..... 503/208

*Primary Examiner*—Bruce H. Hess
*Attorney, Agent, or Firm*—Oblon, Spivak, McClelland, Maier & Neustadt

[57] ABSTRACT

A thermosensitive recording material with a highly improved dynamic coloring sensitivity, comprising a support, and a coloring layer formed thereon, which comprises (a) a leuco dye, (b) at least one of 1,7-bis(4-hydroxphenylthio)-3,5-dioxahepetane and 1,5-bis(4-hydroxyphenylthio)-3-oxapentane as a color developer, and (c) a dibenzyl oxalate derivative having formula (I) as a sensitizer:

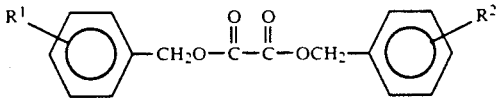

(I)

wherein $R^1$ and $R^2$ each independently represent hydrogen, an alkyl group having 1 to 4 carbon atoms, a halogen or a hydroxyl group.

5 Claims, No Drawings

THERMOSENSITIVE RECORDING MATERIAL

BACKGROUND OF THE INVENTION

1. Field of the Invention

This invention relates to a thermosentive recording material, and more particularly to a thermosensitive recording material with an improved dynamic coloring sensitivity, utilizing a coloring reaction between (i) a leuco dye which is colorless or assumes a pale color at room temperature and (ii) a color developer capable of inducing color formation in the leuco dye upon application of heat thereto.

2. Discussion of Background

Recently, various information recording materials of a non-environmental-pollution type, capable of nursing resources and economizing energy, have been developed and put to practical use for the purpose of dealing with a great variety of abundant information. In particular, thermosensitive recording materials have been widely employed in various fields, for instance, for use with terminal printers for computers and calculators, recorders for medical measurement instruments, low- and high-speed facsimile apparatus, automatic ticket vending machines and thermal copying apparatus, because of the following advantages thereof:

(1) images can be readily recorded on a thermosensitive recording material by simply applying heat thereto without employing a complicated development process;

(2) a relatively simple and small-sized apparatus is usable for preparing a thermosensitive recording material, and the obtained recording material is easily handled and requires a low maintenance cost; and (3) in the case where paper, which is not costly as compared with other materials, is used as a support, a thermosensitive recording material with the plain paper-like touch is obtainable.

In general, the thermosensitive recording material is prepared by coating a liquid for forming a thermosensitive coloring layer, containing a coloring component capable of inducing color formation upon application of heat thereto, onto the surface of paper, synthetic paper or a plastic film, and then dried. Images are recorded on the recording material thus prepared by a thermal pen or a thermal head.

The conventional thermosensitive recording materials, as disclosed, for instance, in Japanese Patent Publications 43-4160 and 45-14039, have shortcomings in that their thermal response is not quick and they cannot yield color images with high density when high-speed recording is conducted.

In order to eliminate the above shortcomings, 3-N-methyl-N-cyclohexylamino-6-methyl-7-anilinofluoran and 3-dibutylamino-6-methyl-7-anilinofluoran have been developed as leuco dyes having high thermal sensitivity, as disclosed in Japanese Laid-Open Patent Applications 49-109120 and 59-190891, respectively.

Furthermore, Japanese Laid-Open Patent Applications 59-106456 and 59-116262 disclose that images can be recorded at high speed with high thermal sensitivity when 1,7-bis(4-hydroxyphenylthio)-3,5-dioxaheptane or 1,5-bis(4-hydroxyphenylthio)-3-oxapentane is used as a color developer.

Japanese Laid-Open Patent Applications 59-101392, 61-123584, 61-215087 and 61-242889 disclose that a recording material having high thermal sensitivity can be obtained and high-speed printing can also be achieved when the above described leuco dyes and color developers ar used in combination.

However, the dynamic coloring sensitivity of the above-described thermosensitive recording materials is not sufficiently high for use in practice.

SUMMARY OF THE INVENTION

Accordingly, it is an object of the present invention to provide an improved thermosensitive recording material having high thermal sensitivity, in particular, high dynamic coloring sensitivity.

The object of the present invention can be achieved by a thermosensitive recording material comprising a support, and a coloring layer formed thereon, which comprises (a) a leuco dye, (b) at least one of 1,7-bis(4-hydroxyphenylthio)-3,5-dioxaheptane and 1,5-bis(4-hydroxyphenylthio)-3-oxapentane as a color developer, and (c) a dibenzyl oxalate derivative having formula (I) as a sensitizer:

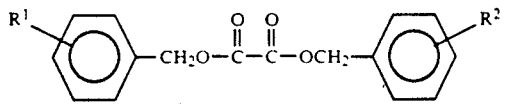

(I)

wherein $R^1$ and $R^2$ each independently represent hydrogen, an alkyl group having 1 to 4 carbon atoms, a halogen or a hydroxyl group.

DETAILED DESCRIPTION OF THE PREFERRED EMBODIMENTS

A coloring layer of the present invention comprises a leuco dye, 1,7-bis(4-hydroxyphenylthio)-3,5-dioxaheptane and/or 1,5-bis(4-hydroxyphenylthio)-3-oxapentane as a color developer, and a dibenzyl oxalate derivative having formula (I) as a sensitizer:

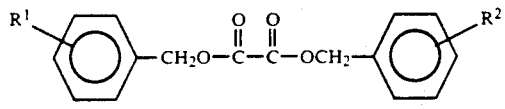

(I)

wherein $R^1$ and $R^2$ each independently represent hydrogen, an alkyl group having 1 to 4 carbon atoms, a halogen or a hydroxyl group.

The 1,7-bis(4-hydroxyphenylthio)-3,5-dioxaheptane and the 1,5-bis(4-hydroxyphenylthio)-3-oxapentane have the following formula (II) and (III), respectively:

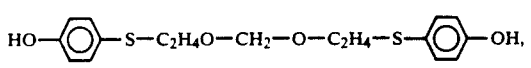

(II)

and

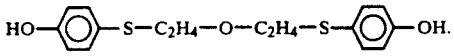

(III)

Examples of the alkyl group represented by $R^1$ or $R^2$ in formula (I) include a methyl group, an ethyl group, a n-propyl group, an i-propyl group, a n-butyl group, an i-butyl group and a tert-butyl group.

Examples of the halogen represented by $R^1$ or $R^2$ in formula (I) are chlorine, bromine and fluorine, and among them, chlorine is preferred.

Since the color developer of formula (II) and/or formula (III) and the sensitizer of formula (I) are incorporated into the coloring layer in combination, the thermosensitive recording material of the present invention exhibits high dynamic coloring sensitivity. The recording material of the present invention is thus suitable for high-speed recording.

The use of the color developer of formula (III) along with the sensitizer of formula (I) is preferable. In the case where these materials are incorporated into the coloring layer in combination, the dynamic thermal sensitivity of the recording material is considerably improved.

Furthermore, the most preferred combination is the color developer of formula (III) and the sensitizer of formula (I) having hydrogen or a methyl group as $R^1$ or $R^2$.

Specific examples of dibenzyl oxalate derivatives of formula (I) are shown in Table 1. However, the present invention is not limited by these compounds.

TABLE 1

| Compound No | Position of $R^1$ | $R^1$ | Position of $R^2$ | $R^2$ |
|---|---|---|---|---|
| 1 | — | H | — | H |
| 2 | p- | $CH_3$ | p- | $CH_3$ |
| 3 | p- | $C_2H_5$ | p- | $C_2H_5$ |
| 4 | p- | n-$C_3H_7$ | p- | n-$C_3H_7$ |
| 5 | p- | iso-$C_3H_7$ | p- | iso-$C_3H_7$ |
| 6 | p- | n-$C_4H_9$ | p- | n-$C_4H_9$ |
| 7 | p- | iso-$C_4H_9$ | p- | iso-$C_4H_9$ |
| 8 | p- | t-$C_4H_9$ | p- | t-$C_4H_9$ |
| 9 | p- | Cl | p- | Cl |
| 10 | p- | Br | p- | Br |
| 11 | p- | OH | o- | OH |
| 12 | o- | $CH_3$ | o- | $CH_3$ |
| 13 | o- | $C_2H_5$ | o- | $C_2H_5$ |
| 14 | o- | n-$C_3H_7$ | o- | n-$C_3H_7$ |
| 15 | o- | iso-$C_3H_7$ | o- | iso-$C_3H_7$ |
| 16 | o- | n-$C_4H_9$ | o- | n-$C_4H_9$ |
| 17 | o- | iso-$C_4H_9$ | o- | iso-$C_4H_9$ |
| 18 | o- | t-$C_4H_9$ | o- | t-$C_4H_9$ |
| 19 | o- | Cl | o- | Cl |
| 20 | o- | Br | o- | Br |

In addition to the above-described color developer and sensitizer, the following auxiliary components may be incorporated into the coloring layer, if necessary: a sensitizer to still more enhance the thermal response, an auxiliary color developer to improve the reliability of recorded images, an inorganic filler, an organic filler, a surface active agent, a binder agent to firmly bond the coloring layer onto a support.

Any known binder agents are usable in the present invention. Specific examples of the binder agents include polyvinyl alcohol, cellulose derivatives such as hydroxyethyl cellulose, carboxymethyl cellulose, methyl cellulose and ethyl cellulose, water-soluble polymers such as sodium polyacrylate, polyvinyl pyrrolidone, a copolymer of acrylic amide and acrylic ester, a terpolymer of acrylic amide, acrylic ester and methacrylic acid, an alkaline salt of a styrene - maleic anhydride copolymer, an alkaline salt of an isobutyrene - maleic anhydride copolymer, polyacrylamide, sodium alginate, gelatin and casein, latexes of polyvinyl acetate, polyurethane, a styrene - butadiene copolymer, polyacrylic acid, polyacrylate, a vinyl chloride - vinyl acetate copolymer, polybutyl methacrylate, an ethylene - vinyl acetate copolymer and a styrene - butadiene - acrylic acid copolymer.

Conventional color developers, which are electron acceptor-type compounds, such as phenol compounds, thiophenol compounds, thiourea derivatives, organic acids and metal salts thereof can be used as the auxiliary color developers.

The following compounds are preferably used in the present invention as the auxiliary color developers: 4,4'-thiobis(6-tert-butyl-2-methyl)phenol, 2,2'-methylenebis(4-methyl-6-tert-butylphenol), 1,1,3-tris(2-methyl-4-hydroxy-5-tert-butylphenylbutane), 1,1,3-tris(2-methyl-4-hydroxy-5-cyclohexylphenyl)butane, tetrabromo bisphenol S, and behenic acid.

Examples of the fillers which may be additionally incorporated into the coloring layer of the present invention include fine powder of inorganic fillers such as calcium carbonate, silica, zinc oxide, titanium oxide, aluminum hydroxide, zinc hydroxide, barium sulfate, clay, talc, surface-treated calcium and surface-treated silica; and fine powder of organic fillers such as a urea-formalin resin, a styrene - methacrylic acid copolymer and a polystyrene resin.

Any leuco dyes which have been used in the conventional thermosensitive recording materials ca be used in this invention.

Examples of the leuco dyes include triphenyl methane-type leuco compounds, fluorane-type leuco compounds, phenothiadine-type leuco compounds, Auramine-type leuco compounds, spiropyran-type leuco compounds, and indolinophthalide-type leuco compounds. These leuco dyes are used either singly or in combination.

Specific examples of the leuco dyes are as follows:

3,3-bis(p-dimethylaminophenyl)-phthalide,
3,3-bis(p-dimethylaminophenyl)-6-dimethylaminophthalide or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-N-methyl-N-propyl-6-methyl-7-anilinofluoran,
3-N-ethyl-N-isoamyl-6-methyl-7-anilinofluoran,
3-diethylamino-7-chlorofluoran,
3-diethylamino-7-methylfluoran,
3-diethylamino-7,8-dibenzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis[diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4'-dimethylanilino)fluoran,
3-(N,N-diethylamino)-5-methyl-7-(N,N-dibenzylamino)fluoran,
Benzoyl leuco methylene blue,
6'-chloro-8'-methoxy-benzoindolino-spiropyran,
6-bromo-3'-methoxy-benzoindolino-spiropyran, 3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl) phthalide,
3-morpholino-7-[N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-methyl-N-isopropylamino)-6-methyl-7-anilino-fluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-dimethylamino-6-chloro-7-anilinofluoran,
3-N-ethyl-N-(2-ethoxypropyl)amino-6-methyl-7-anilino fluoran,
3-N-ethyl-N-tetrahydrofurfurylamino-6-methyl-7-anilinofluoran,
3-diethylamino-6-methyl-7-mesidino-4',5'-benzofluoran,
3-N-methyl-N-isobutyl-6-methyl-7-anilinofluoran,
3-N-ethyl-N-isoamyl-6-methyl-7-anilinofluoran, and
3-diethylamino-6-methyl-7-(2',4'-dimethylanilino)fluoran.

The thermosensitive recording material according to the present invention can be prepared by coating a liquid containing the above-mentioned components for the coloring layer, such as the leuco dye, the color developer, the sensitizer, and, if necessary, the auxiliary agents, onto the surface of a support such as a sheet of paper or synthetic paper, or a plastic film, and then dried. Thereafter the coloring layer thus formed is subjected to calendering. An undercoat layer may be interposed between the support and the coloring layer, and an overcoat layer may be formed on the surface of the coloring layer, if necessary.

The amount of the color developer is preferably 100 to 600 wt. % , more preferably 300 to 500 wt. %, of the weight of the leuco dye. The amount of the sensitizer is preferably 50 to 400 wt. %, more preferably 100 to 300 wt. %, of the weight of the leuco dye.

Other features of this invention will become apparent in the course of the following description of exemplary embodiments, which are given for illustration of the invention and are not intended to be limiting thereof.

EXAMPLE 1

Preparation of Liquid A

The following components were placed in a sand mill pot, and dispersed for 2 to 5 hours to obtain Liquid A.

| | parts by weight |
|---|---|
| 3-Dibutylamino-6-methyl-7-anilinofluoran | 20 |
| 10% Aqueous solution of polyvinyl alcohol | 20 |
| Water | 60 |

Preparation of Liquid B

The following components were placed in a sand mill pot, and dispersed for 2 to 5 hours to obtain Liquid B.

| | parts by weight |
|---|---|
| 1,5-Bis(4-hydroxyphenylthio)-3-oxapentane | 10 |
| Calcium carbonate | 10 |
| 10% Aqueous solution of polyvinyl alcohol | 20 |
| Water | 60 |

Preparation of Liquid C

The following components were placed in a sand mill pot, and dispersed for 2 to 5 hours to obtain Liquid C.

| | parts by weight |
|---|---|
| Dibenzyl oxalate | 20 |
| 10% Aqueous solution of polyvinyl alcohol | 20 |
| Water | 60 |

Preparation of Recording Material

The above-prepared Liquids A, B and C were mixed with a weight ratio of 1:8:2 to obtain a mixture for forming a coloring layer. 3.0 g/m$^2$ (dry basis) of the mixture was coated onto the surface of high quality paper having a basis weight of 47g/m$^2$, and then dried to form a coloring layer. Thereafter, the coloring layer was subjected to calendering, whereby thermosensitive recording material No. 1 according to the present invention was prepared.

EXAMPLE 2

The procedure in Example 1 was repeated except that the 1,5-bis(4-hydroxyphenylthio)-3-oxapentane used for Liquid B in Example 1 was replaced by 1,7-bis(4-hydroxyphenylthio)-3,5-dioxaheptane, whereby thermosensitive recording material No. 2 according to the present invention was prepared.

EXAMPLE 3

The procedure in Example 1 was repeated except that the 3-dibutylamino-6-methyl-7-anilinofluoran used for Liquid A in Example 1 was replaced by 3-N-methyl-N-isobutyl-6-methyl-7-anilinofluoran, and the dibenzyl oxalate used for Liquid C in Example 1 was replaced by di(p-methylbenzyl) oxalate, whereby thermosensitive recording material No. 3 according to the present invention was prepared.

EXAMPLE 4

The procedure in Example 1 was repeated except that the 3-dibutylamino-6-methyl-7-anilinofluoran used for Liquid A in Example 1 was replaced by 3-N-methyl-N-isobutyl-6-methyl-7-anilinofluoran, and the dibenzyl oxalate used for Liquid C in Example 1 was replaced by di(p-chlorobenzyl) oxalate, whereby thermosensitive recording material No. 4 according to the present invention was prepared.

COMPARATIVE EXAMPLE 1

The procedure in Example 1 was repeated except that the 1,5-bis(4-hydroxyphenylthio)-3-oxapentane used for Liquid B in Example 1 was replaced by bisphenol A, whereby comparative thermosensitive recording material No. 1 was prepared.

COMPARATIVE EXAMPLE 2

The procedure in Example 1 was repeated except that the dibenzyl oxalate used for Liquid C in Example 1 was replaced by 1-benzylbiphenyl, whereby comparative thermosensitive recording material No. 2 was prepared.

The above prepared thermosensitive recording materials Nos. 1 to 4 according to the present invention and comparative thermosensitive recording materials Nos. 1 and 2 were evaluated in terms of the dynamic coloring sensitivity.

Each recording material was loaded in a thermal printer having a thin film head (made by Matsushita Electronic Components Co., Ltd.), and images were printed under the following conditions:

| | |
|---|---|
| Head power | 0.45 W/dot |
| Recording time for one line | 20 msec/line |
| Line density | 8 × 3.85 dots/mm |
| Pulse width | 0.2 msec, 0.4 msec, 0.6 msec, 0.8 msec, and 1.0 msec. |

The density of the printed image was measured by a McBeth densitometer "RD-914". The results are shown in Table 2.

TABLE 2

| Recording Material | Density of Background | Density of Printed Images Pulse Width (msec) 0.2 | 0.4 | 0.6 | 0.8 | 1.0 |
|---|---|---|---|---|---|---|
| No. 1 | 0.08 | 0.31 | 0.97 | 1.26 | 1.27 | 1.27 |
| No. 2 | 0.08 | 0.23 | 0.81 | 1.19 | 1.26 | 1.26 |
| No. 3 | 0.09 | 0.27 | 0.92 | 1.21 | 1.27 | 1.27 |
| No. 4 | 0.09 | 0.25 | 0.88 | 1.17 | 1.26 | 1.26 |
| Comp. No. 1 | 0.08 | 0.15 | 0.71 | 1.11 | 1.24 | 1.27 |
| Comp. No. 2 | 0.09 | 0.19 | 0.75 | 1.14 | 1.23 | 1.26 |

The data shown in the above table clearly demonstrate that the dynamic coloring sensitivity of the thermosensitive recording materials according to the present invention is higher than that of the comparative thermosensitive recording materials.

What is claimed is:

1. A thermosensitive recording material comprising a support and a coloring layer formed thereon, said coloring layer comprising:

(a) a leuco dye, (b) at least one of 1,7-bis(4-hydroxyphenylthio)-3,5-dioxaheptane and 1,5-bis(4-hydroxyphenylthio)-3-oxapentane as a color developer, and (c) a dibenzyl oxalate derivative having formula (I) as a sensitizer:

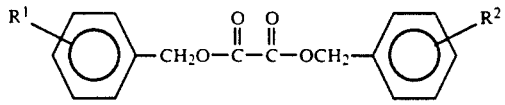

(I)

wherein $R^1$ and $R^2$ each independently represent hydrogen, an alkyl group having 1 to 4 carbon atoms, a halogen or a hydroxyl group.

2. The thermosensitive recording material as claimed in claim 1, wherein said alkyl group represented by $R^1$ or $R^2$ in formula (I) is selected from the group consisting of a methyl group, an ethyl group, a n-propyl group, an i-propyl group, a n-butyl group, an i-butyl group, and a tert-butyl group.

3. The thermosensitive recording material as claimed in claim 1, wherein said halogen represented by $R^1$ or $R^2$ in formula (I) is selected from the group consisting of chlorine, bromine and fluorine.

4. The thermosensitive recording material as claimed in claim 1, wherein the amount of said color developer is 100 to 600 wt. % of the weight of said leuco dye.

5. The thermosensitive recording material as claimed in claim 1, wherein the amount of said sensitizer is 50 to 400 wt. % of the weight of said leuco dye.

* * * * *